United States Patent [19]

Pierce

[11] 4,257,169

[45] Mar. 24, 1981

[54] COMMODITY DRYER

[76] Inventor: Jack Pierce, 807 11th St., Grundy Center, Iowa 50638

[21] Appl. No.: 967,978

[22] Filed: Dec. 11, 1978

[51] Int. Cl.[3] ..... F26B 3/04; F26B 21/08

[52] U.S. Cl. ..... 34/27; 34/46; 34/77; 34/225; 62/432

[58] Field of Search ..... 99/468, 474, 475, 483; 62/176 R, 90, 155, 186, 213, 229, 79, 238 E, 442, 324 D, 432; 34/27, 32, 46, 77, 67, 50, 225, 48; 426/520

[56] References Cited

U.S. PATENT DOCUMENTS

| | | | |
|---|---|---|---|
| 1,119,011 | 12/1914 | Grosvenor | 34/77 |
| 1,995,551 | 3/1935 | Shodron | 34/225 |
| 2,799,947 | 7/1957 | Elwess | 34/77 |
| 3,105,365 | 10/1963 | Harris et al. | 62/324 D |
| 3,934,355 | 1/1976 | Weibull | 34/77 |

*Primary Examiner*—Larry I. Schwartz

*Attorney, Agent, or Firm*—Breneman, Kane & Georges

[57] ABSTRACT

A commodity dryer for removing or providing moisture and controlling atmosphere which surrounds stored commodities such as grain is provided which reduces the growth of bacteria, fungus and minimizes other deleterious conditions encountered such as in the storage of moist commodities which generally render them unfit for subsequent consumption. The commodity dryer maintains the integrity of stored commodities by creating a controlled atmosphere conducive to the removal or the addition of water by capillary action from the pores of the commodity and for controlling the moisture and temperature around the skin of the grain to achieve optimum storage conditions for the specific commodity stored. The commodity dryer achieves its advantages by recycling, monitoring and modifying the air as it cycles through the commodity storage bin by introducing dried air from the top of the commodity bin down through the commodity contained therein and back to an evaporator heat exchanger coil for the removal of moisture and then back to a condenser heat exchanger coil to pick up heat for subsequent recirculation back to the top of the bin and back through the commodity.

21 Claims, 4 Drawing Figures

COMMODITY DRYER

BACKGROUND OF THE INVENTION

1. Field of the Invention

The present invention relates to a commodity dryer for controlling the relative amount of moisture retained in the commodity and the surrounding atmosphere to not only dry but also to promote capillary action in the commodity to provide the optimum moisture to heat content of the grain by recirculating the air in the dryer and commodity bin while monitoring ambient conditions. More particularly the invention pertains to a commodity dryer which monitors the atmosphere of the commodity in relation to ambient temperature and storage bin heat transfer and depending upon the moisture requirements of the commodity may gradually introduce warm dry air into the top of the commodity bin while taking out moisture laden air from the bottom of the commodity bin or adding moisture to the commodity by adding moisture laden air to the top of the commodity bin. Moisture content of this air is controlled by passing the air through an evaporator heat exchanger coil which cools and thereby controls the amount of humidity in the air and transports the air to the condenser heat exchanger coil to pick up sufficient heat to gradually optimize the conditions in the commodity bin.

2. Description of the Prior Art

Various efforts have been made in the prior art and in the recent past to provide a commodity dryer to increase the storage life and quality of wheat, nuts, corn and other commodities in storage bins while maintaining the integrity of the vitamins, minerals, proteins, starches and sugars in the stored commodities. A practical commodity dryer has been required in agriculture since time immemorial since some years provide bumper crops of various commodities whereas some years due to draught and adverse growing conditions have produced inferior yields resulting in great fluctuations in the price of agricultural commodities.

There has been as a result numerous efforts to provide various types of commodity storage bins, grain elevators and the like to even out the years of bumper and lean crop production. The known storage devices have not solved the perennial problem since large masses of stored commodities have not been susceptible to prolonged periods of storage since the growth of fungus, bacteria and rot has resulted in a significant waste of agricultural commodities. The internal conditions of the storage bin are the net result of ambient temperature in conjunction with the condition of the commodity inside the bin and resulting heat transfers. These three factors many times combine to result in deleterious changes in atmospheric conditions around the mass of the grain causing all or part of the agricultural commodity to spoil.

In U.S. Pat. No. 2,661,603 a vault conditioner with control means is disclosed for controlling the relative humidity and temperature of merchandise storage vaults. This vault conditioner is described as being a self-contained machine constructed to meet the storage requirements of furs, foods, seeds and other products sensitive to water vapor and temperature. In operation, the vault conditioner withdraws air from the ceiling level of the storage room, cools it, reduces its humidity, and then discharges it at the floor level of the room. The invention as disclosed in U.S. Pat. No. 2,661,603 apparently utilizes convection current in assisting the action of the vault conditioner since the warmest air collects at the ceiling level from where it is withdrawn and returned to the cooling and dehumidifying unit for recirculation.

The commodity dryer of the present invention in contrast operates on an entirely different principle. The present commodity dryer creates a controlled atmosphere around the commodity by monitoring internal storage bin conditions and provides either moisture or dry air to provide the optimum conditions required for prolonged storage while preserving the nutritional value of the vitamins, minerals, proteins, starches, and sugars of the stored commodity. The internal conditions of the bin and grain as heretofore described are economically controlled as a result of a correlation of the internal conditions of the storage bin with the external ambient air conditions and resulting heat transfers. For example when a wet commodity is first stored in the present system, the commodity dryer adds dry air to the top of the commodity bin and removes moist humid air from the bottom of the commodity bin. The quantity of dry air added and the amount of wet moist air removed per unit of time depends upon the degree of moisture requiring removal to provide optimum storage conditions for the particular ambient temperature encountered in the storage location. The commodity dryer of the present invention may furthermore operate to provide both heat and dry air that is added to the commodity bin to dry wheat, corn, nuts and other grains stored in the commodity bin as it monitors the conditions both inside and outside the commodity bin to gradually optimize the conditions required for prolonged storage of agricultural commodities. The difference in design, function, and economic considerations of the present invention further translates into different arrangement and utilization of components to achieve the advantages of the invention. The present commodity dryer for example employs a compressor for driving an evaporator for cooling and removing moisture from the air and operating a condenser for thereafter reheating the dried air. The present unit further employs a hot/gas bypass for the efficient removal of ice from fins disposed on the evaporator heat exchanger coil where the commodity is in an extremely cold climate and/or is in an especially wet condition when stored.

The prior art has not provided a commodity dryer that will extend the life of stored commodities by controlling and gradually optimizing the atmosphere surrounding the commodity to yield after the removal of excessive moisture the optimum atmosphere necessary to prolong and preserve the vitamins, oils, minerals, proteins, starches and sugars indigenous to the condition of the particular stored commodity. The commodity dryer of the present invention is further designed to accomodate ambient atmospheric conditions at the site of the commodity dryer to provide the most efficient utilization of temperature and conditions for the removal or the addition of moisture to prolong the life of the stored commodity. The commodity dryer of the invention is further designed to coordinate outside temperature conditions with the internal conditions of the grain in the commodity bin to efficiently optimize the drying conditions of the grain in conjunction with the overall energy necessary to operate the system.

SUMMARY OF THE INVENTION

The disadvantages and limitations of prior art storage equipment is obviated by the present invention which provides for a controlled atmosphere around stored commodities to provide either a drying or humidifying action to retard the formation of bacteria, fungus and spoilage. The present commodity dryer provides for prolonged storage of commodities by gradually optimizing the atmospheric conditions in relation to outside temperature to provide the best storage conditions for the particular commodity in regard to the geographical location of the stored commodity. The present commodity dryer is adjustable not only to the particular commodity being dried but also the moisture content of the commodity at all stages of its storage. The control system of the commodity dryer after attaining the optimum condition of the stored commodity thereafter monitors outside atmospheric conditions to achieve the optimum internal moisture in relation to ambient and commodity bin conditions to provide for the optimum internal conditions for the prolonged storage of the commodity.

The novel commodity dryer of the invention achieves its advantages by heating, adding, or removing moisture or a combination thereof from the internal or core portion of the grain and controlling the atmosphere surrounding the grain so that proper aspiration of the moisture content of the grain precludes the growth of bacteria, fungus, and the advent of decay and rot which decreases the life of the commodity. The commodity dryer achieves its advantages by reducing the retained moisture of the stored commodities which generally upon changes in temperature and humidity in compacted storage conditions fosters the formation of bacteria and fungus growth and spoilage which generally renders moist commodities stored in commodity bins unfit for subsequent consumption.

It will be recognized that the present commodity dryer by controlling the internal atmosphere of the commodity while monitoring the outside ambient conditions provides for a reduction of the energy required to maintain the commodity at a predetermined optimum moisture content at a given temperature. Thereafter temperature increases which increase the amount of moisture released by capillary action from the pores of the store commodity may be utilized to thereafter efficiently and gradually withdraw excesss moisture from the stored commodity to protect the oils, vitamiuns, salts, proteins, starches and sugars present in the commodity.

The novel commodity dryer of the invention achieves its advantages by the removal of moisture from and around the grain stored in the commodity dryer by inducing capillary action of the water content from the pores of the commodity or grain stored in the commodity bin. The moisture and temperature conditions between the internal or embryo moisture of the shell or skin of the kernel and the atmosphere surrounding the commodity are together vitally important in maintaining the storage life of the commodity. Each commodity has its particular requirements of internal and external moisture content that may be acdommodated by adjustments made in the control system of the present commodity dryer. It will be recognized that commodities such as dates require a greater moisture content than walnuts which requirements may be accommodated in adjusting the control unit as will be described herein after in greater detail.

In accordance with the invention a commodity is stored in a bin which is attached to the commodity dryer, the atmosphere is generally gradually reduced in temperature by gradually reducing the volume of dry air introduced at the top of the commodity dryer. The gradual reduction of temperature creates a skin temperature of the grain below that of the embryo resulting in a migration of moisture from the embryo toward the shield or shell part of the kernel. The gradual reduction in shell temperature of the grain below that of the embryo results in the migration of moisture to the skin of the embryo where the atmosphere surrounding the skin of the embryo is cooler and lower in humidity resulting in the evaporation of moisture to the atmosphere which is subsequently removed by the evaporator heat exchanger coil of the commodity dryer.

The gradual reduction in temperature results in a superior drying technique in that the oils, vitamins, salts, proteins, starches, sugars and trace nutrients of the commodity are not removed with the water. It will be recognized that nutrients remaining in the water are increasingly resistant to evaporating through the shell or skin of the commodity so that additional lowering of the temperature results in this moisture being increasingly retainable by the commodity. As a result, further drops in temperature after the additional drying period results in the commodity maintaining its vitamins, proteins, starches and sugars indigenous to the particular commodity stored in the commodity dryer.

The advantages of the present invention are best achieved when the present commodity dryer is utilized with a storage bin of a cylindrical configuration. In the preferred embodiment of the invention an enclosed commodity bin is provided having a sealable fill port, a false preforated bottom, a sealable drain and plenum connections for both inlet and outlet ports to the commodity dryer. The size of the commodity dryer bin should be in the range of 1,000 to 100,000 bushels and have a height to width ratio of greater than or equal to 1 to 1. The configuration of the commodity bin increases the efficiency of airflow from the novel commodity dryer over the skin or shell of the commodity and thereby further increases the advantages of the invention in providing greater moisture control per unit of energy expended.

The agricultural commodity dryer is attached to the commodity bin so that the exhaust port which is disposed at the bottom of the commodity bin is attached to the inlet port of the commodity dryer wherein moisture laden gases from the commodity are circulated past the evaporator heat exchanger coil which utilizes from about one fin to 6 inches to 15 fins per inch depending upon the type of climate conditions in which the commodity dryer is in operation. For example where the ambient or outside temperatures generally include high temperature and high humidity the evaporator heat exchanger coils are equipped with about 6 to 10 fins per inch. On the other hand where ambient temperatures include low humidity and high temperatures the evaporator may be of a smaller size and utilize an evaporator heat exchanger coil having more than 10 fins per inch. However, in environments having high humidity with temperatures near or below the freezing point the evaporator heat exchanger coil preferably utilizes from about 1 fin per 2½ to 3 inches. In climate conditions having both a low temperature and a low humidity an evaporator heat exchanger coil having about one fin per inch provides a system that is controllable for a variety of commodities. In climates where extremely low temperatures i.e. about 40° to 0° F. are common and/or where excessive heat losses occur through the bin walls it is preferable to introduce small amounts of auxiliary heat to the air prior to reintroducing the air to the top of the commodity bin.

In the foregoing discussion the number of fins per inch as described in reference to a commodity bin of about 60,000 to 100,000 bushel in capacity. Furthermore the description of the number of fins per inch in the evaporator heat exchanger coil have been described with reference to an evaporator heat exchanger coil of about ⅜ of an inch in diameter having each fin approximately 2½ inches wide and 5½ inches long. It will be recognized that the application of the present invention to larger commodity bins having a greater flow of air or the utilization of evaporator heat exchanger coils of varying diameter with result in variation in the size and number of fins per inch as heretofore described.

It has been further discovered that the differential between the requirements of the commodity as it relates to ambient temperature conditions is generally a more significant consideration in controlling the atmosphere surrounding the commodity than the particular commodity being stored. The requirements of the commodity are however a significant consideration where the commodity requires a high degree of moisture such as dates, apricots and raisins. In the application of the present invention to such commodities the commodity dryer can be designed to remove less moisture from the air removed from the bottom of the commodity bin by variation in the compressor, condenser and evaporator operation and ratings or changes in blower velocity and/or the utilization of a slightly fewer number of fins per inch to allow additional moisture to remain in the system.

The purpose of the number of fins per inch is to assist not only in the control of the moisture content of the storage bin but also to foster the removal of ice from the evaporator heat exchanger coil if the moisture laden air causes ice to form on the evaporator heat exchanger coil in which case the ice is melted off by utilizing a hot gas bypass. The chilled air is then passed through the condenser heat exchanger coil to be reheated by the condenser heat exchanger coil after which the dry air is transported to the top of the commodity bin down through the commodity and back to the evaporator heat exchanger to complete the cycle. A forced blower or fan is utilized to provide positive circulation of the closed atmosphere created by the industrial commodity dryer in the storage bin. The displacement and pressure resistance to flow is sized to provide a 60,000 BTU differential or greater depending on the time of drying required to provide a flow through the commodity.

In a further embodiment the invention can be implemented by utilizing at certain times a quantity of ambient air in achieving the advantages and benefits of the invention. More particularly in circumstances where the outside air is of a moisture or humidity and temperature that is compatible with the requirements of the commodity a control means can be provided to utilize ambient air for limited periods of time to assist in the control of moisture of the stored commodity to further reduce the cost of operating the commodity dryer.

The evaporator heat exchanger coil as heretofore described is designed to be of a sufficient size and have a sufficient surface area to remove moisture and gradually dry the commodity in the storage bin. Furthermore, the commodity dryer in the preferred embodiment is equipped to add moisture and/or heat to further assist in drying and long term storage capabilities. For example, for a 100,000 bushell bin storage unit a 60 ton evaporator coil and a 75 ton condenser heat exchanger coil would be employed to provide a 30-day drying period. However in the event a 15-day drying period is desired for a 100,000 bushel bin a 120 ton evaporator heat exchanger coil and a 150 ton condenser coil to provide for the drying of the commodity. In the preferred embodiment the heat produced by the condenser heat exchanger coil is utilized in whole or in part to reheat the air prior to its introduction back to the top of the bin for subsequent cycling down through the commodity and through the false bottom of the commodity storage bin.

It will be recognized that the advantages of the invention may be achieved by utilizing any cooling device that is capable of producing temperatures below that of the saturation temperature of the atmosphere being removed from the commodity bin. This may be below the saturation temperature of the water due to dew point suppressants that may still be soluable in the moisture being removed from the stored commodity.

In a similar manner it will be recognized that the afterheat source or the condenser heat exchanger coil may be constructed of any device that has a controllable heat source which will raise the deliquescence level of the air being returned to the commodity dryer. Commonly, this is the refrigerate condenser heat exchanger coil which produces a proportional dewpoint differential of about 2,545 BTUs per horsepower used to produce the refrigeration necessary to cool the condensing coil. Since the refrigerants have generally lower horsepower per BTU requirements for compression at lower temperatures, the drier the commodity becomes the less horsepower required to control the atmosphere inside the storage bin.

The advantages of the invention in utilizing the present commodity dryer is that the nutrients in the commodities are retained in the comodity since the moisture is generally removed from the commodity without raising the temperature of the commodity. In addition, the energy required to remove the moisture is lowered because the residual heat of the commodity is utilized to evaporate its contained moisture. Furthermore, the gradual optimization of the atmosphere surrounding the commodity reduces bacteria, fungus and spoilage. These advantages are achieved by the novel commodity dryer while saving energy since the external energy of the refrigeration system is recovered in the after heating coil.

Other advantages of the present invention will become apparent to those skilled in the art from the specification in conjunction with the appended drawings which illustrates various aspects of the commodity dryer and method of drying commodities in accordance with the invention.

DESCRIPTION OF THE DRAWINGS

The invention and its advantages will be further described in the following detailed description taken in conjunction with the accompanying drawings in which.

DETAILED DESCRIPTION OF THE INVENTION

Figure 1:
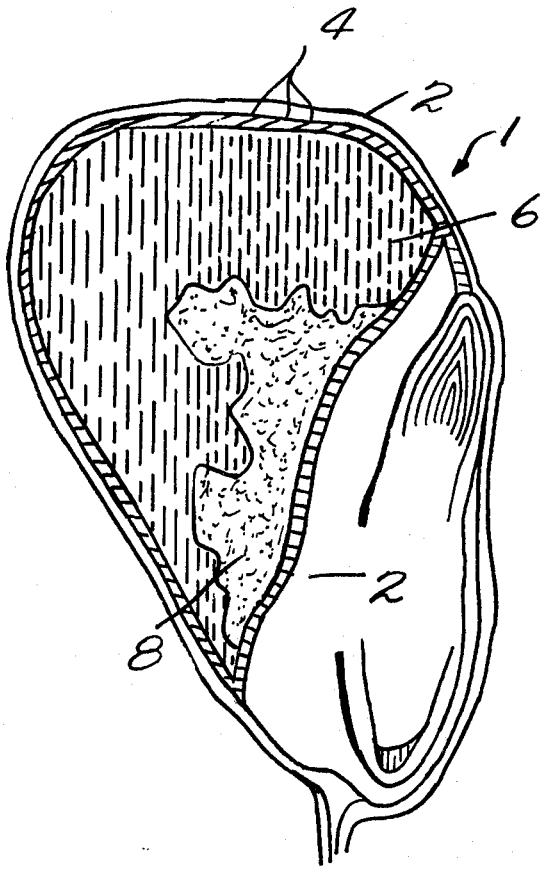
FIG. 1 is an enlarged view partly in section of a kernel of corn representing one type of grain suitable for drying in the commodity dryer of the invention.

Referring now to FIG. 1 a grain such as a kernel of corn 1 is depicted partly in section illustrating the outer shell 2 having pores 4 therein communicating with the outer shell of the corn along with the yellow proteid part of the endosperm 6 of the corn. A white starchy portion 8 is also illustrated with portions 6 and 8 containing after harvest relatively large amounts of moisture as is well-known to those in the agricultural art. In addition to moisture inside the corn shell 2, moisture may also be present surrounding the external shell 2 particularly, under some harvesting conditions which is aggravated when the commodity is tightly packed in a commodity storage bin. The removal of excessive moisture both inside the commodity and surrounding the outside area of the commodity is important for prolonged periods of commodity storage. More particularly the commodity dryer of the invention protects the commodity from the growth of bacteria while maintaining the quality of the commodity in storage by creating a controlled atmosphere surrounding the commodity which is conducive to the removal or addition of water by capillary action through pores 4 of the commodity.

Figure 2:
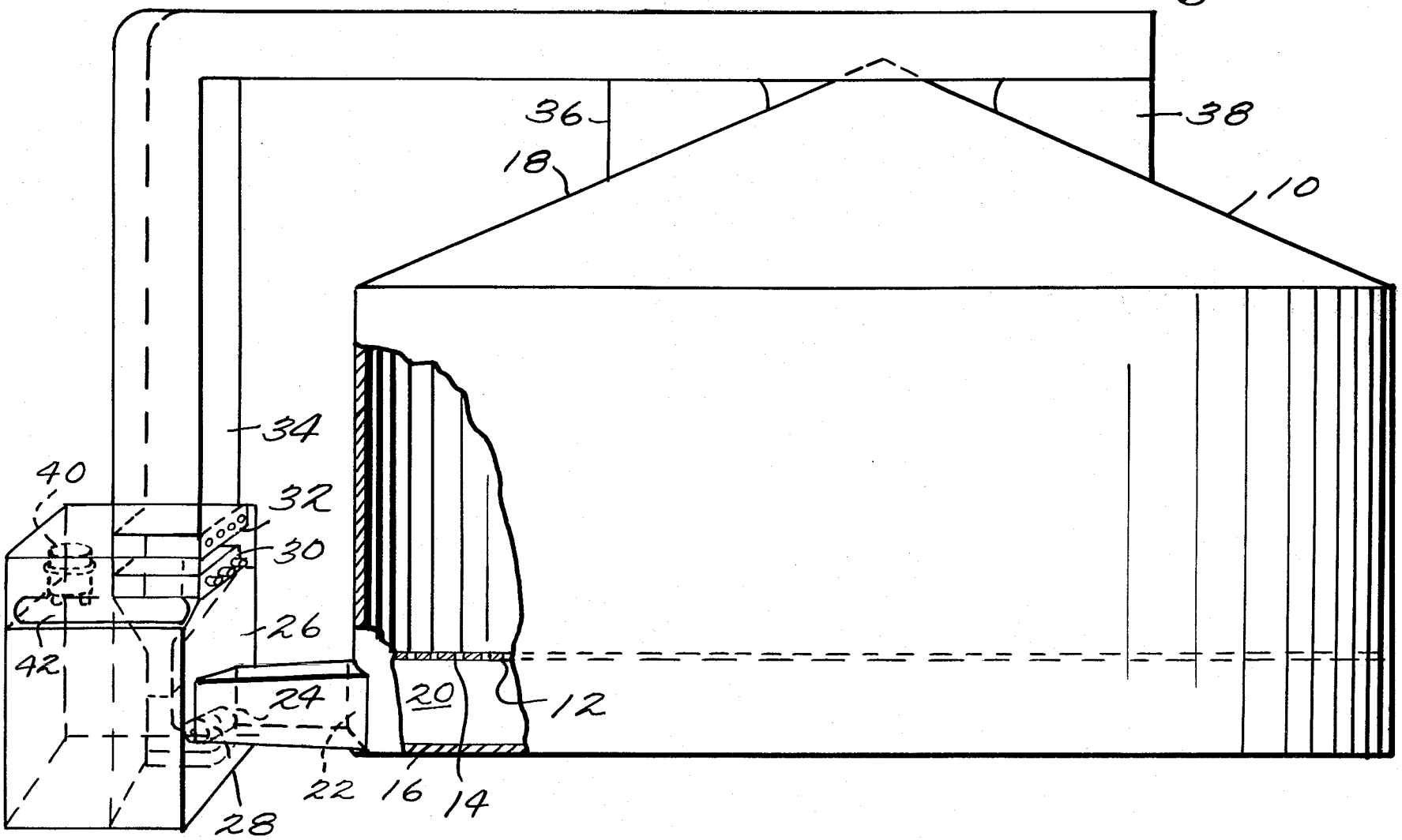
FIG. 2 is a side elevational view partly in section illustrating a commodity bin associated with a commodity dryer in accordance with the invention.

In FIG. 2 a storage bin 10 constructed in accordance with the preferred embodiment is illustrated in which commodities such as corn, grain, nuts and other eatable substances having an internal and external moisture content may be stored and dried and maintained in an atmosphere of controlled moisture content so as to retard the growth of bacteria, fungus and other deleterious conditions that would otherwise shorten the storage life of the commodity. The commodity bin 10 is preferably of a cylindrical cross-sectional configuration having a false bottom 12 containing minute perforations 14 therein of a size sufficient to restrain the commodity from the bottom 16 of the bin 10 while allowing drying air introduced in the top 18 of the commodity bin 10 to be extracted from the space 20 formed at the bottom of the commodity bin 10 via exhaust port 22 connected to an inlet 24 in commodity dryer housing 26. A blower fan 28 is provided in the commodity dryer to provide a positive circulation of air through the commodity in commodity bin 10 to withdraw moisture laden air from the bottom of the commodity bin and transport the air into commodity dryer housing 26. This moisture laden air is contacted with an evaporator heat exchanger coil 30 having from about 1 fin to six inches to 15 Fins per inch depending upon climate conditions as heretofore described so that if ice forms during the cooling of the air received from the commodity bin 10 it may be removed by a hot gas bypass. The air from the commodity bin 10 is thereby cooled so that moisture is withdrawn from the air prior to its contacting condenser heat exchanger coil 32 which is responsible for reheating the air to about the temperature of the air removed from space 20 of commodity bin 10 prior to its transportation via duct 34 back to the top 18 commodity dryer 10. Duct 34 preferably branches into one or more ducts 36 and 38 to provide a uniform introduction of dry air to the top 18 of the commodity bin 10. Evaporator heat exchanger coil 30 and condenser heat exchanger coil 32 are operatively connected to a compressor 40 which in the preferred embodiment energizes both an evaporator for the removal of moisture and a condenser for reheating the air prior to the reintroduction of the dried air back into the commodity bin. The commodity dryer may include an inlet 42 for the introduction of ambient air when the ambient air has a temperature and moisture content that is capatible with the moisture requirements of the commodity at a particular storage and/or drying cycle.

The novel commodity dryer may range in sizes from 5 tons of refrigeration up to 500 tons. The commodity dryer achieves its advantages by monitoring, controlling and reusing the same air by providing a closed atmosphere in which the moisture content of the commodity bin is gradually reduced or increased in relation to the moisture requirements of the commodity at various stages of storage and the ambient atmospheric conditions at the storage location. In general for a given temperature and commodity as the humidity of the location of the commodity dryer increases the number of fins decreases as has heretofore been described in order to allow the removal of moisture from the evaporator heat exchanger coil. It will be recognized that the size and configuration of the fins of the evaporator coil may be modified in accordance with the invention as long as the unit is constructed to create a moisture controlled atmosphere surrounding the commodity to control by capillary action the water content of the stored commodity. To assist in the control of moisture in the stored commodity, the air within the commodity bin 10 is moved at a slow velocity generally about 500 cubic feet per minute with an operational range of about 200 to 1,000 cubic feet per minute. The unit is designed to float from about 65 lbs. to 10 lbs. suction pressure which of course depends upon differences in the amount of chaff or small particulate matter associated with the commodity.

It will be recognized that the velocity of the air over the evaporator coil fins in conjunction with the fin size determines to a large degree the moisture maintenance capacity of the commodity dryer for the type of climate conditions encountered as heretofore described. Furthermore, the capacity of the commodity dryer for a given volume of storage is given a fixed velocity of air related to coil length or area.

Figure 3:
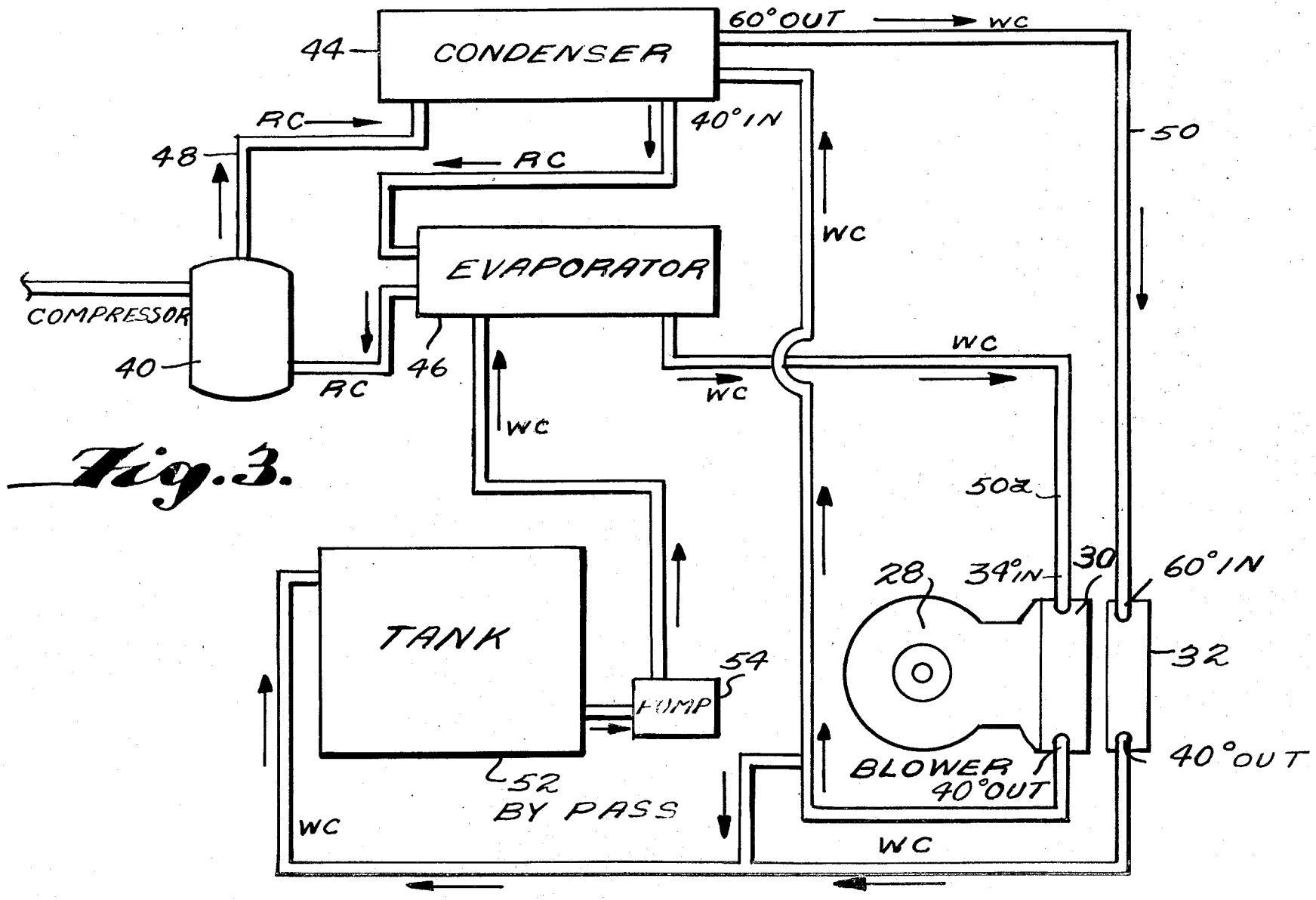
FIG. 3 is a schematic diagram of a novel commodity dryer constructed in accordance with the invention.

In FIG. 3 a schematic diagram of the commodity dryer of FIG. 2 illustrates further details of the internal components of the commodity dryer wherein the compressor 40 operates both a condenser 44 and an evaporator 46 by regrigerant conduit 48. A conventional variable control unit for controlling the power input to compressor 40 controls the operation of the compressor which may be coupled with the speed of blower fan 28 in effectuating the drying of the commodity in the commodity bin. The control system of the commodity dryer is similar in operation to industrial refrigeration devices wherein compressor 40 and refrigerant conduit 48 which may contain a standard refrigerant such as freon or any number of other available refrigerants known to those skilled in the art.

A second conduit 50 which may be filled with water or preferably a combination of water and glycol or glycol solution operates as a heat transfer fluid which in conjunction with evaporator 46 provides the cooling achieved by the evaporator heat exchanger coils 30 which cools commodity bin air received from inlet 24 (FIG. 2). More particularly as is illustrated by way of example in FIG. 3 the evaporator 46 provides an output about 34° F. via conduit 50*a* to evaporator heat exchanger coils 30 which cools commodity bin air by transporting the commodity bin air over coils 30 by the operation of blower 28. The heat exchange fluid leaves evaporator heat exchanger coils 30 and returns to the condenser at about 40° F. The condenser 44 also provides through water conduit 50 provides heat to condenser heat exchanger coil 32 to reheat the dried air prior to its reintroduction to the commodity bin. In the case of the present example, the water conduit is introduced to condenser heat exchanger coil 32 at about 60° F. and returns to the evaporator 46 at about 40° F. Also provided is a tank 52 and pump 54 for circulating water conduit 50 and 50*a* for providing the heat transfers for drying and reheating the air to and from the commodity bin.

Figure 4:
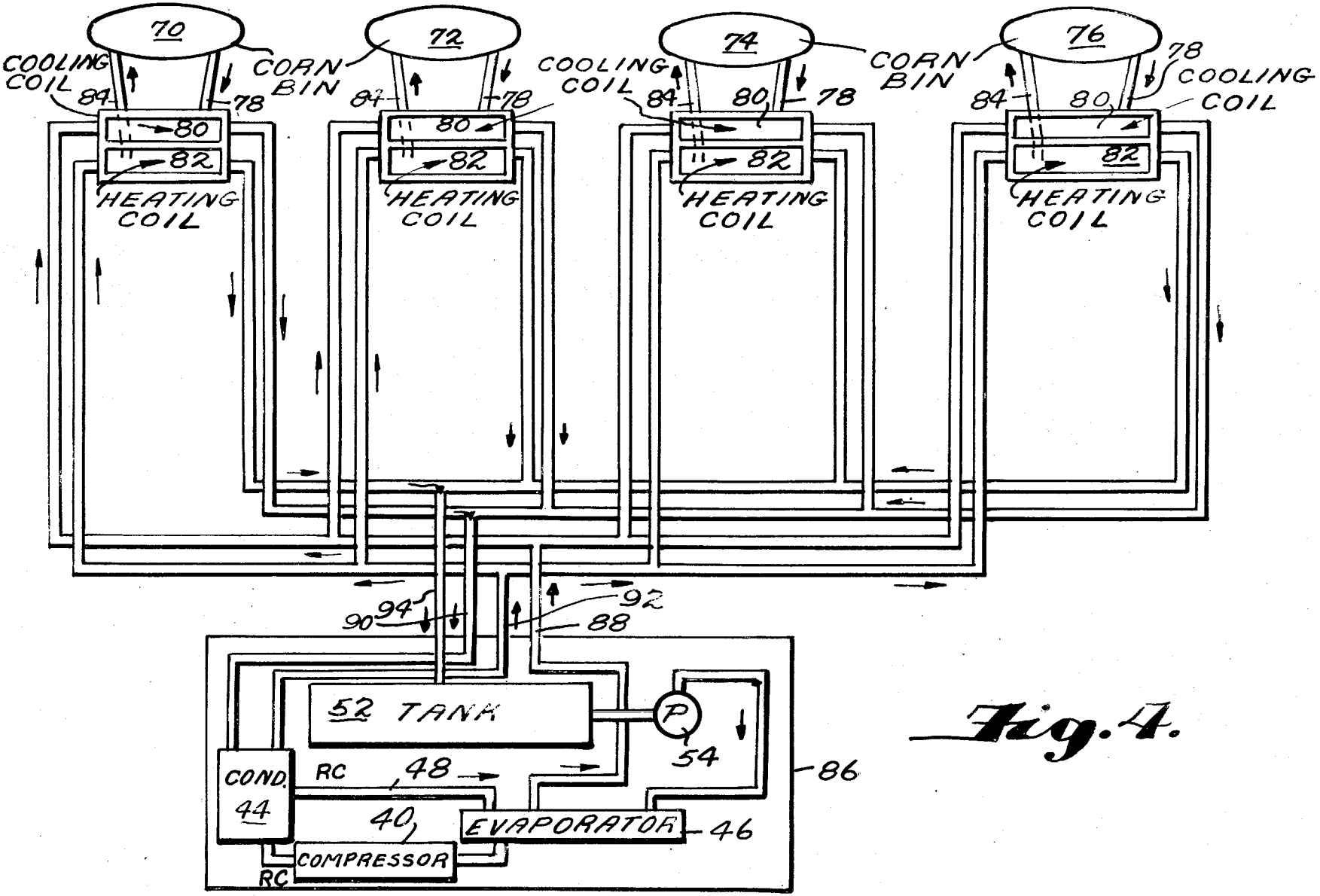
FIG. 4 is a schematic diagram of an alternative embodiment of the application of the novel commodity dryer to four commodity bins.

Referring now to FIG. 4 a further embodiment of the invention is illustrated wherein the novel commodity dryer employs separate evaporator heat exchanger coils and condenser heat exchanger coils for controlling the atmosphere of separate commodity bins. In this embodiment commodity bins such as corn bins 70, 72, 74 and 76 each have an air port 78 to transport air from the bottom of the bin to an evaporator heat exchanger coil 80 which thereafter transports the air to a condenser heat exchanger coil 82 and back to the top of the commodity bin via an air port 84. Preferably a variable speed blower and control for the evaporator and condenser heat exchanger coils is provided to assist in the control of the conditions in each of the commodity bins.

Commodity dryer 86 operates each of the evaporator heat exchanger coils 80 and condenser heat exchanger coils 82 by providing a refrigeration coil 48 between compressor 40, condenser 44 and evaporator 46 in a manner similar to FIG. 3. Similarly evaporator 46 provides via a heat transfer fluid conduit 88 a cooled glycol solution to operate each of the evaporator heat exchanger coils 80. From the evaporator heat exchanger coils 80 a return conduit 90 transport the warmed glycol solution to the condenser 44 to pick up further heat and is transported via conduit 92 to condenser heat exchanger coils 82 to reheat the commodity bin air prior to its reintroduction to the top of commodity bins 70, 72, 74 and 76. After reheating the commodity bin air through condenser heat exchanger coils 82 the cooled glycol solution is returned via conduit 94 to tank 52 and pump 54 back to evaporator 46 to thereafter again be transported to evaporator heat exchanger coil 80 via conduit 88 to continue the cooling and heating cycle of the commodity bin air. A separate variable speed blower (not shown) is associated with each of the corn bins 70, 72, 74 and 76 to assist in the separate control of each of the bins by varying the velocity of air flow through the commodity as heretofore described. It will be recognized that the utilization of glycol filled lines 88, 90, 92 and 94 allow one compressor to operate a condenser and evaporator which in turn operate the multiple heat exchanges without requiring separate compressors, condensers and evaporators or the purchase of a number of individual commodity dryers to further reduce cost of acquisition and operation.

In the preferred embodiment the configuration of the corn bin is of a cylindrical configuration having a height to width ratio of greater than or equal to 1 to 1. It will be recognized that other configurations and other methods of utilizing the commodity dryer to various arrays of corn bins or other type of commodity bins may be accomplished by those skilled in the art. Furthermore, the corn dryer of the present invention may be further modified in applications involving the arrangement of multiple commodity bins by having separate control systems utilized for heating and cooling of air for each individual commodity in an arrangement of bins in which each bin may contain a different commodity. It of course will be recognized where different commodities are utilized in each commodity bin different conditions are required so that the commodity dryer should be set up to accommodate the optimum conditions for each of the commodities stored. It will be further recognized that application of individualized control of each of the commodity bins may be accomplished utilizing a central control unit for all the bins or by individually analyzing and treating air withdrawn from the bottom of the commodity bins through the evaporator and condenser heat exchanger coils. It will be further recognized that in this embodiment individualized conditions for the commodity bin may be further optimized by having a heater located just prior to the introduction of the air from the commodity dryer air return line into the particular bin to provide heat where it is necessary to heat the air introduced to the top of the commodity bin to optimize the conditions for the commodity stored in a particular storage bin.

It will be recognized that the present invention has a wide range of applicability to various foods and food products wherein the moisture content of the food in conjunction with the storage temperature can be controlled to optimize and maintain the commodity in a prolonged storable condition. It will be recognized that the invention may be further modified to provide a variety of atmospheres to surround the commodity and to introduce various airborne ingredients into the commodity bin via the atmosphere utilized to control the storage life of the stored commodity. These and other applications of the invention may be made within the spirit and scope of the invention as defined in the appended claims.

What is claimed is:

1. A method of drying and storing commodities having a shell portion and an embryo portion for extending periods comprising:

(a) flowing commodity bin air from one end of a commodity bin to the other end of the said commodity bin and around a commodity contained therein;

(b) removing said commodity bin air by withdrawing said air from one end of said commodity bin;

(c) adjusting the air moisture content of said removed air in correlation to the relative state of dryness and the moisture requirements of said commodity by a gradual reduction of temperature and humidity of said air by utilizing residual heat in said commodity to dry said commodity by reducing the shell temperature of said commodity below that of the embryo to provide a loss of moisture from said commodity to said air until additional decreases in temperature does not remove additional moisture from said commodity with respect to the commodity bin air temperature by suppressing the dew point of said removed air in correlation to the moisture requirements of said commodity to dry and store said commodity without heating said air unless the temperature of said commodity bin air is at or near the freezing point of water; and (d) returning said air to the other end of said commodity bin to control the moisture content of the air flowing around said stored commodity.

2. The method of drying and storing commodities for extended periods of claim 1 further comprising the addition of ambient air when said ambient air has a temperature and moisture content that is compatible with the moisture requirements of said commodity.

3. The method of drying and storing commodities for extended periods of claim 1 wherein said commodity bin air flowing around said commodity is continuously recycled and the moisture content of said air is adjusted in conjunction with ambient air and temperature conditions.

4. The method of drying and storing commodities for extended periods of claim 1 wherein said commodity bin air is added to a top end of said commodity bin and is withdrawn from a bottom end of said commodity bin.

5. The method of drying and storing commodities for extended periods of claim 4 wherein said modification of commodity bin air comprises removing moisture from said air by a reduction in temperature as it is removed from the bottom end of said commodity bin and reheating said air to about the temperature of said air when it was withdrawn from the bottom end of said commodity bin prior to its addition to said top end of said commodity bin.

6. The method of drying and storing commodities for extended periods of claim 5 wherein said modification of commodity bin air further comprises reheating said air to a temperature above the temperature of said air when it was withdrawn from the bottom end of said commodity bin prior to its addition to said top end of said commodity bin.

7. The method of drying and storing commodities for extended periods of claim 5 wherein said commodity bin air is flowed through said commodity at about 200 to 1,000 cubic feet per minute.

8. The method of drying and storing commodities for extended periods of claim 7 wherein said commodity bin air is flowed through said commodity at about 500 cubic feet per minute.

9. The method of drying and storing commodities for extended periods of claim 1 wherein said modification of said commodity bin air removed from said commodity bin comprises adding moisture to said air prior to flowing said air through said commodity.

10. The method of drying and storing commodities for extended periods of claim 1 further comprising the addition of airborne treating materials to said commodity bin air prior to flowing said air through said commodity.

11. A commodity dryer for drying and storing commodities for extended periods comprising:

(a) at least one first heat exchanger said first heat exchanger communicating with an air inlet for removing moisture from air from an air supply communicating with said inlet;

(b) at least one second heat exchanger said second heat exchanger communicating with an air outlet said second heat exchanger providing a heating means for said air;

(c) means for the operation of said first heat exchanger and said second heat exchanger;

(d) control means for operating said first heat exchanger and said second heat exchanger to suppress the dew point of air in correlation to the moisture requirements of a stored commodity, the commodity bin air temperature and ambient temperature conditions to return said air to a commodity bin at a suppressed dew point said control means operating said second heat exchanger when the temperature of said commodity bin air is at or near the freezing point of water;

(e) at least one means for transporting air from a commodity bin through said air inlet and said air outlet and back to said commodity bin.

12. The commodity dryer for drying and storing commodities for extended periods of claim 11 wherein said means for the operation of said first heat exchanger and said second heat exchanger is a compressor, evaporator and condenser.

13. The commodity dryer for drying and storing commodities for extended periods of claim 12 wherein said evaporator is operatively connected to said first heat exchanger and said condenser is operatively connected to said second heat exchanger by a conduit containing a heat transfer fluid.

14. The commodity dryer for drying and storing commodities for extended periods of claim 13 wherein said evaporator is connected to a plurality of first heat exchangers and said condenser is connected to a plurality of second heat exchangers wherein each of said first and said second heat exchangers are associated with a separate commodity bin.

15. The commodity dryer for drying and storing commodities for extended periods of claim 14 wherein said means for transporting air includes a plurality of variable speed blowers for transporting said air through said separate commodity bins and said first heat exchanger and said second heat exchanger at individually variable rates of from about 200 to 1000 cubic feet per minute.

16. The commodity dryer for drying and storing commodities for extended periods of claim 11 further comprising means for correlating ambient temperature and moisture conditions in conjunction with commodity moisture requirements and utilizing ambient air for moisture or drying when said ambient air corresponds to the moisture requirements of said commodity.

17. A commodity dryer for drying and storing commodities comprising:

(a) a housing, said housing including an inlet and outlet port;

(b) a first heat exchanger communicating with said inlet port for the removal of moisture from air removed from a commodity bin;

(c) a second heat exchanger communicating with said outlet port for the return of heat to said air;

(d) control means for correlating ambient temperature conditions with moisture requirements of the commodity for the operation of said first and second heat exchangers to provide for the proper outlet port moisture level said control means operating said second heat exchanger when the temperature of said commodity bin air is at or near the freezing point of water; and (e) a blower for transporting said air from a commodity bin to said first and second heat exchangers.

18. The commodity dryer for drying and storing commodities of claim 17 wherein said control means further includes means for admitting ambient air to a commodity bin when said ambient conditions are compatible with the moisture requirements of said commodity.

19. The commodity dryer for drying and storing commodities of claim 17 wherein said blower is a variable speed blower capable of displacing from about 200 to 1,000 cubic feet of air per minute.

20. The commodity dryer for drying and storing commodities of claim 17 wherein said control means comprises a first heat exchanger coil having from about one fin to 6 inches to 15 fins per inch wherein said evaporator coil is about $\frac{3}{8}$ inch in diameter and each fin is about $2\frac{1}{2}$ inches wide and $5\frac{1}{2}$ inches long.

21. The commodity dryer for drying and storing commodities of claim 17 wherein said first heat exchanger and said second heat exchanger are operatively connected by way of a conduit utilizing a heat transfer fluid to an evaporator and condenser respectively wherein said evaporator and condenser is operated by a compresser.

* * * * *